US006812640B2

(12) United States Patent
Setoguchi

(10) Patent No.: US 6,812,640 B2
(45) Date of Patent: Nov. 2, 2004

(54) PLASMA DISPLAY PANEL

(75) Inventor: Noriaki Setoguchi, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 30 days.

(21) Appl. No.: 10/388,402

(22) Filed: Mar. 17, 2003

(65) Prior Publication Data

US 2003/0184224 A1 Oct. 2, 2003

(30) Foreign Application Priority Data

Mar. 27, 2002 (JP) ..... 2002-087921

(51) Int. Cl.[7] ..... H01J 17/49
(52) U.S. Cl. ..... 313/582; 313/584
(58) Field of Search ..... 313/582, 584, 313/586

(56) References Cited

U.S. PATENT DOCUMENTS 6,172,461 B1 * 1/2001 Ha ..... 313/585

* cited by examiner

*Primary Examiner*—Vip Patel
(74) *Attorney, Agent, or Firm*—Staas & Halsey LLP

(57) ABSTRACT

A plasma display panel includes a first substrate and a second substrate opposed to each other, a plurality of sustain electrodes arranged parallel to each other on an inside surface of the first substrate, a plurality of ribs arranged orthogonally to the sustain electrodes on an inside surface of the second substrate, and elongated address electrodes each arranged between adjacent ribs, wherein adjacent sustain electrodes have a pair of protrusions projected in a direction approaching each other and one of the pairs of protrusions of two adjacent sustain electrode pairs is displaced from the other pair of protrusions along the sustain electrodes between the ribs.

10 Claims, 10 Drawing Sheets

PLASMA DISPLAY PANEL

CROSS-REFERENCE TO RELATED APPLICATION

This application is related to Japanese application No. 2002-087921 filed on Mar. 27, 2002, whose priority is claimed under 35 USC §119, the disclosure of which is incorporated by reference in its entirety.

BACKGROUND OF THE INVENTION

1. Field of the Invention

The present invention relates to a plasma display panel in which light emitting regions are selected by address electrodes and display is performed by making use of gas discharge between a pair of sustain electrodes. In particular, it relates to a plasma display panel having the sustain electrodes and the address electrodes of improved structure.

2. Description of Related Art

A plasma display panel (PDP) to which light emission by electric discharge is applied has conventionally been used as a large and thin display device. The conventional PDP includes, as shown in FIG. 9, a front substrate 100, a rear substrate 200 and mixture gas of neon/xenon or helium/xenon which is filled as discharge gas between the front substrate 100 and the rear substrate 200. On an inner surface of a glass substrate 111 which serves as a base material of the front substrate 100, a plurality of sustain electrode pairs 110 each including a first sustain electrode 114 and a second sustain electrode 113 for causing surface discharge for display are arranged parallel to each other. The first and second sustain electrodes 114 and 113 are covered with a dielectric layer 115 for AC driving and the surface of the dielectric layer 115 is covered with a protective layer 116. The first and second sustain electrodes 114 and 113 each include transparent conductive films 114*b* and 113*b* and bus electrodes 113*a* and 114*a* of a metal film for ensuring the conductivity.

On an inner surface of a glass substrate 221 which serves as a base material of the rear substrate 200, a plurality of address electrodes 222 for selecting a unit light emitting region in cooperation with the second sustain electrodes 113 are arranged to cross the sustain electrode pairs 110 arranged on the front substrate 100. The address electrodes 222 are covered with a dielectric layer 223 and straight belt-shaped (stripe-shaped) ribs 224 for dividing discharge space are provided on the dielectric layer 223 such that each of which is positioned between two adjacent address electrodes 222. The ribs 224 divide the discharge space into unit light emitting regions along a line direction (pixel arranging direction parallel to the sustain electrodes). In a plurality of concave portions formed of the ribs 224 and the dielectric layer 223, which serve as the discharge spaces, fluorescent layers of R, G and B are arranged in a stripe pattern. The fluorescent layers 225 are excited by ultraviolet rays generated by surface discharge, thereby causing light emission. In this PDP, three adjacent unit light emitting regions (subpixels) comprise a single display pixel. Each of the unit light emitting regions comprises a display cell defined by the first and second sustain electrodes 114 and 113 and an address cell defined between the second sustain electrode 113 and the address electrode 222.

With the above-described structure, display is performed as follows. First, a unit light emitting region is selected by causing address discharge in the address cell between the second sustain electrode 113 of the front substrate 100 and the address electrode 222 of the rear substrate 200. Then, a sustain voltage is applied to the sustain electrode pair 110 to cause discharge only in the display cell of the selected unit light emitting region. Thereby, the fluorescent layers 225 are excited by the ultraviolet rays to emit light.

As another prior art PDP, there is a PDP of ALIS (Alternate lighting of Surfaces) type in which surface discharge for display is caused between adjacent sustain electrodes arranged at regular intervals to realize high resolution and increased pixel number.

The stripe-shaped ribs 225, which are adopted as the mainstream of the panel structure, do not include ribs formed along the arranging direction of the sustain electrodes 113 and 114. Accordingly, discharge interference is apt to occur along the arranging direction of the sustain electrodes 113 and 114, i.e., along the stripe-shaped ribs 225. Therefore, with a view of separating the discharge, width of a reverse slit RS (non-discharge gap) between adjacent sustain electrode pairs 100 where the discharge is not caused is expanded as compared with a slit S (discharge gap) between the paired sustain electrodes 114 and 113 where the discharge is caused. However, as the high resolution progresses and the pixel number increases, the width of the reverse slit RS is reduced and a sufficient distance for separating the discharge cannot be maintained. As shown in FIG. 10, when a sustain voltage is applied to the first sustain electrodes 114 to cause discharge A1 and A3 in the display cells of D1 and D3, the discharge A1 or A3 extends to the display cell D2 adjacent along the stripe-shaped rib 225. That is, discharge interference occurs to cause false discharge A2 (excessive discharge) in the display cell D2, which makes the light emitting operations unstable.

In the other prior art PDP, discharge occurs on both sides of each sustain electrode. Therefore, the interference is prevented by drive control. However, in the case where a pixel pitch along the column direction is reduced for higher resolution, the discharge interference as described above occurs in the column direction, which makes the operations unstable.

SUMMARY OF THE INVENTION

To solve the above-described problems, the present invention intends to provide a PDP which inhibits the discharge interference along the arranging direction of the sustain electrodes without increasing the distance between two adjacent sustain electrode pairs.

The present invention provides a plasma display panel comprising a first substrate and a second substrate opposed to each other, a plurality of sustain electrodes arranged parallel to each other on an inside surface of the first substrate, a plurality of ribs arranged orthogonally to the sustain electrodes on an inside surface of the second substrate, and elongated address electrodes each arranged between adjacent ribs, wherein adjacent sustain electrodes have a pair of protrusions oppositely projected in a direction approaching each other and one of the pairs of protrusions of two adjacent sustain electrode pairs is displaced from the other pair of protrusions along the sustain electrodes between the ribs.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Figure 1:
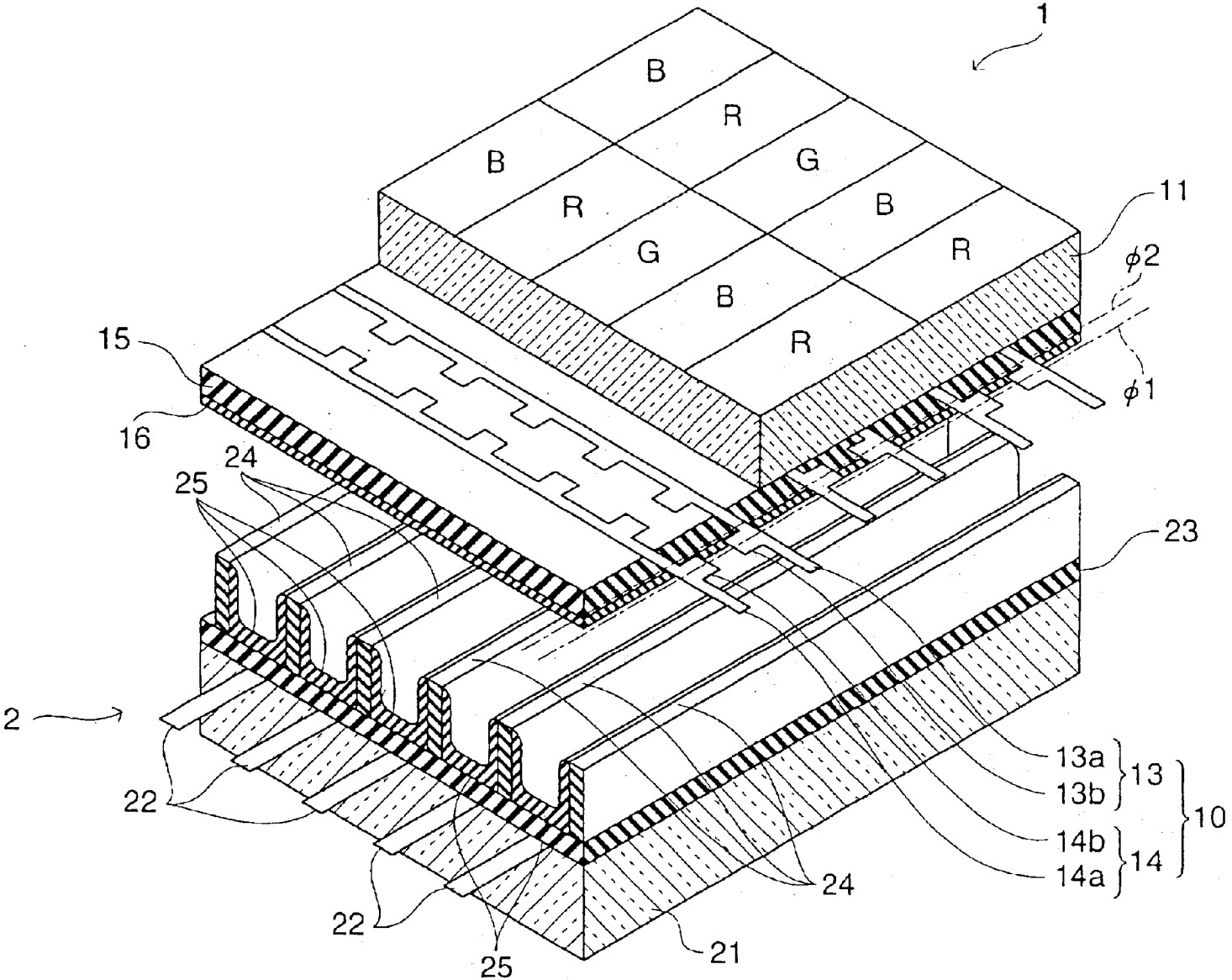
FIG. 1 is a perspective view partially illustrating a plasma display panel according to Embodiment 1 of the present invention.

The plasma display panel according to the present invention comprises a first substrate and a second substrate opposed to each other, a plurality of sustain electrodes arranged parallel to each other on an inside surface of the first substrate, a plurality of ribs arranged orthogonally to the sustain electrodes on an inside surface of the second substrate, and elongated address electrodes each arranged between adjacent ribs, wherein adjacent sustain electrodes have a pair of protrusions oppositely projected in a direction approaching each other and the one pair of protrusions of two adjacent sustain electrode pairs is displaced from the other pair of protrusions along the sustain electrodes between the ribs.

According to the present invention, one of the pairs of protrusions of two adjacent sustain electrode pairs is displaced from the other pair of protrusions along the sustain electrodes. Therefore, false discharge caused by interference from discharge between the one pair of protrusions to the other pair of protrusions is inhibited.

In the present invention, the address electrode may be bended so as to be positioned in correspondence with each pair of protrusions of the two adjacent sustain electrode pairs.

Accordingly, the discharge interference between the adjacent sustain electrode pairs is inhibited and accurate addressing is carried out.

In the present invention, each of the address electrodes may include two parallel electrodes which are cooperatively driven, one of the electrodes being arranged in correspondence with one of the pairs of protrusions of the two adjacent sustain electrode pairs, the other being arranged in correspondence with the other pair of protrusions.

Since the two address electrodes each are arranged in correspondence with the pairs of protrusions displaced from each other, the discharge interference between the adjacent sustain electrode pairs is inhibited and the configuration of the address electrode is simplified. Further, even in the case of a break in one of the address electrodes, the discharge can be caused by the other address electrode.

In the present invention, the two adjacent sustain electrode pairs may each include first and second sustain electrodes, the first and second sustain electrodes causing a surface discharge therebetween for display, the second sustain electrode and the address electrode causing a discharge therebetween for selecting an address, the address electrode being opposed to the protrusion of the second sustain electrode and not opposed to the protrusion of the first sustain electrode.

The two adjacent sustain electrode pairs may each include first and second sustain electrodes, the first and second sustain electrodes causing a surface discharge therebetween for display, the second sustain electrode and the address electrode causing a discharge therebetween for selecting an address, the address electrode overlapping the protrusion of the second sustain electrode in a larger area than the protrusion of the first sustain electrode.

The plasma display panel according to the present invention may further comprises a fluorescent layer formed an each address electrode.

The plurality of sustain electrodes may include a plural of sustain electrode pairs, each pair being composed of two adjacent sustain electrodes, the sustain electrode pairs being spaced apart each other by a distance not enough to cause a discharge therebetween, the pair of opposed protrusions of each sustain electrode pair causing a surface discharge therebetween.

The plurality of sustain electrodes may be spaced apart each other by a distance enough to cause a surface discharge between desired adjacent sustain electrodes, the surface discharge being caused between each pair of protrusions The sustain electrode may be made of a band-shaped metal film and the protrusion may be made of a transparent conductive film.

The sustain electrode may be made of a band-shaped metal film and the protrusion may be made by partially bending the sustain electrode.

Embodiment 1

Figure 3B:
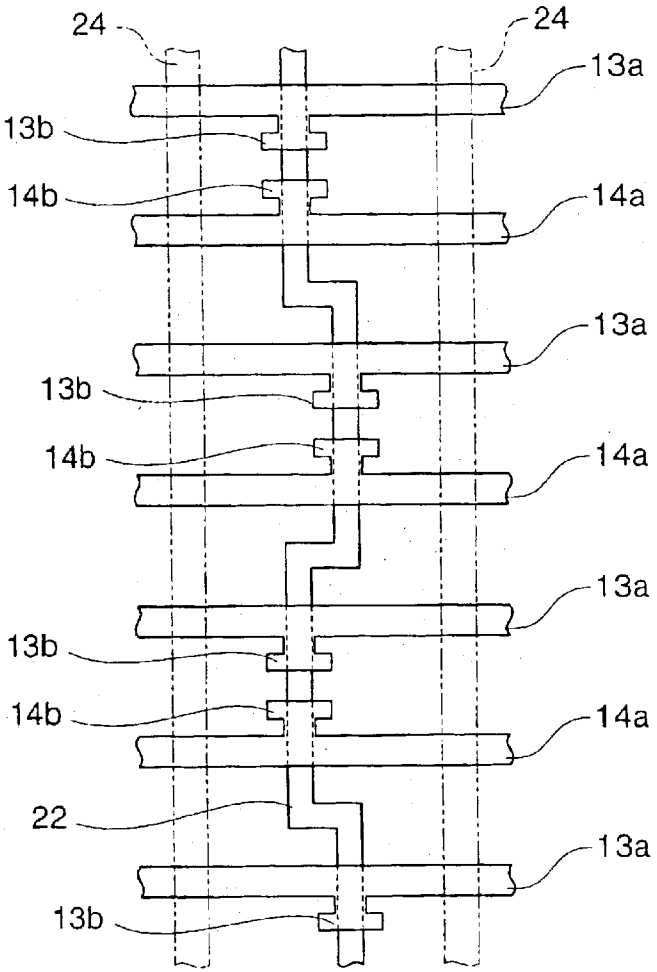
FIGS. 3(*a*) and 3(*b*) are views illustrating electrode structure of the plasma display panel according to Embodiment 1 of the present invention.
Figure 3A:
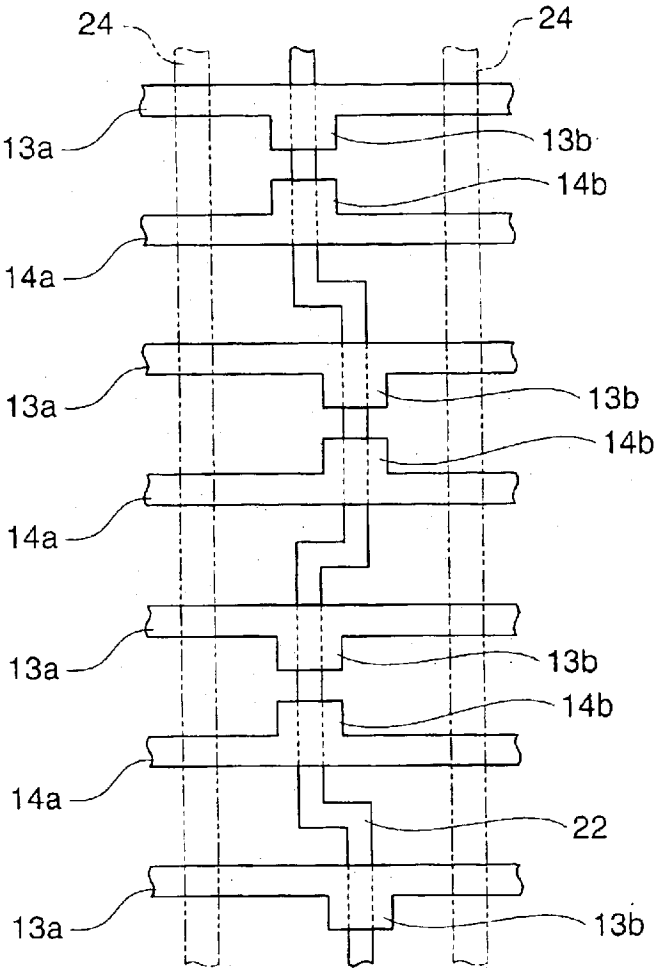
Figure 4:
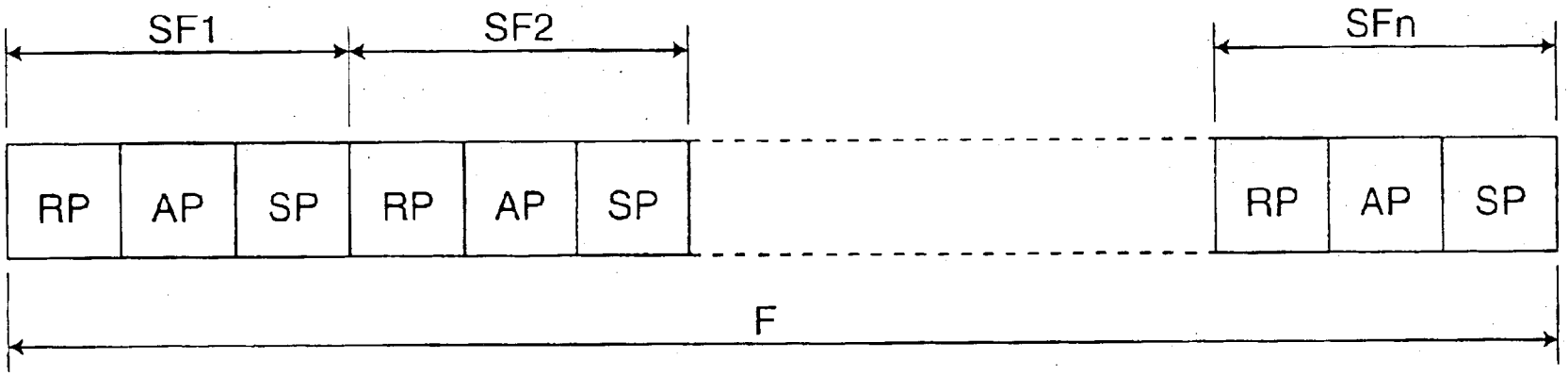
FIG. 4 is a view illustrating frames for driving the plasma display panel according to Embodiment 1 of the present invention.

A plasma display panel according to Embodiment 1 of the present invention is described with reference to FIGS. 1 to 4. FIG. 1 is a perspective view partially illustrating the plasma display panel according to this embodiment, FIGS. 2(*a*) and 2(*b*) are views illustrating electrode structure on a front substrate of the plasma display panel according to this embodiment, FIGS. 3(*a*) and 3(*b*) are views illustrating electrode structure of the plasma display panel according to this embodiment and FIG. 4 is a view illustrating frames for driving the plasma display panel according to this embodiment.

In the plasma display panel of this embodiment shown in the above-mentioned figures, similarly to the prior art panel, discharge gas of a mixture of xenon and neon is filled in discharge spaces between a front substrate 1 and a rear substrate 2. The front substrate 1 includes a plurality of sustain electrode pairs 10, a dielectric layer 15 and a protective layer 16 which cover the sustain electrode pairs 10. Each sustain electrode pair has a first sustain electrode 14 and a second sustain electrode (or a scanning electrode) 13 and the sustain electrode pairs are arranged on an inner surface of a glass substrate 11 with reverse slits therebetween. The rear substrate 2 includes a plurality of address electrodes 22 arranged on an inner surface of a glass substrate 21, a dielectric layer 23 covering the address electrodes 22, a plurality of ribs 24 formed on the dielectric layer 23 and fluorescent layers 25 of R, G and B formed between adjacent ribs 24.

Figure 2B:
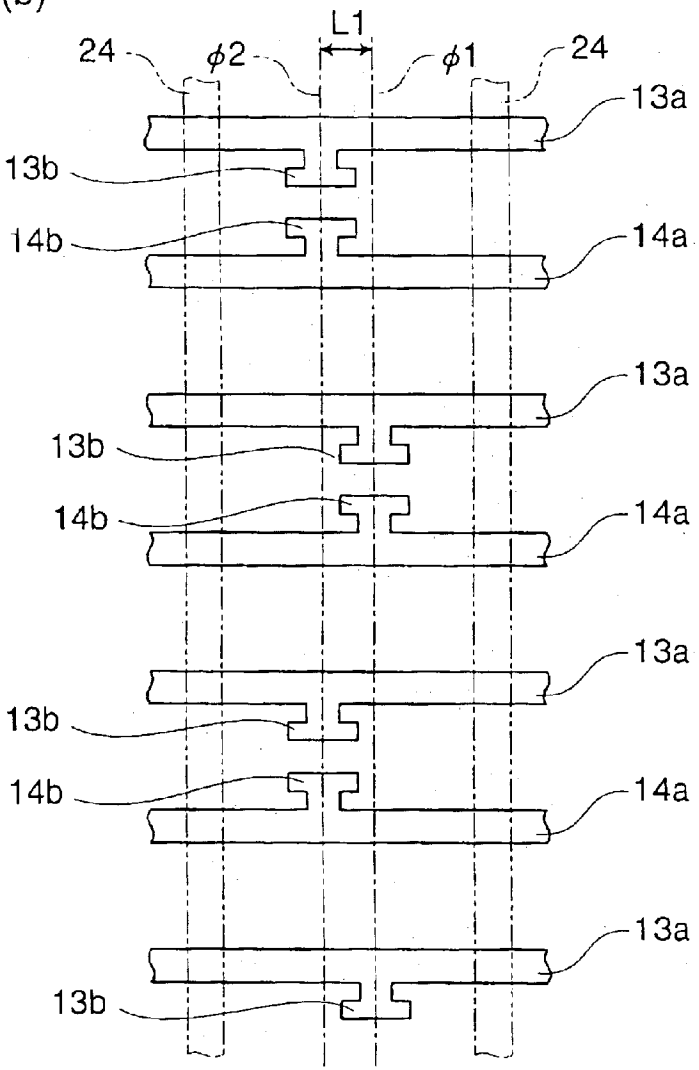
FIGS. 2(*a*) and 2(*b*) are views illustrating electrode structure on a front substrate of the plasma display panel according to Embodiment 1 of the present invention.
Figure 2A:
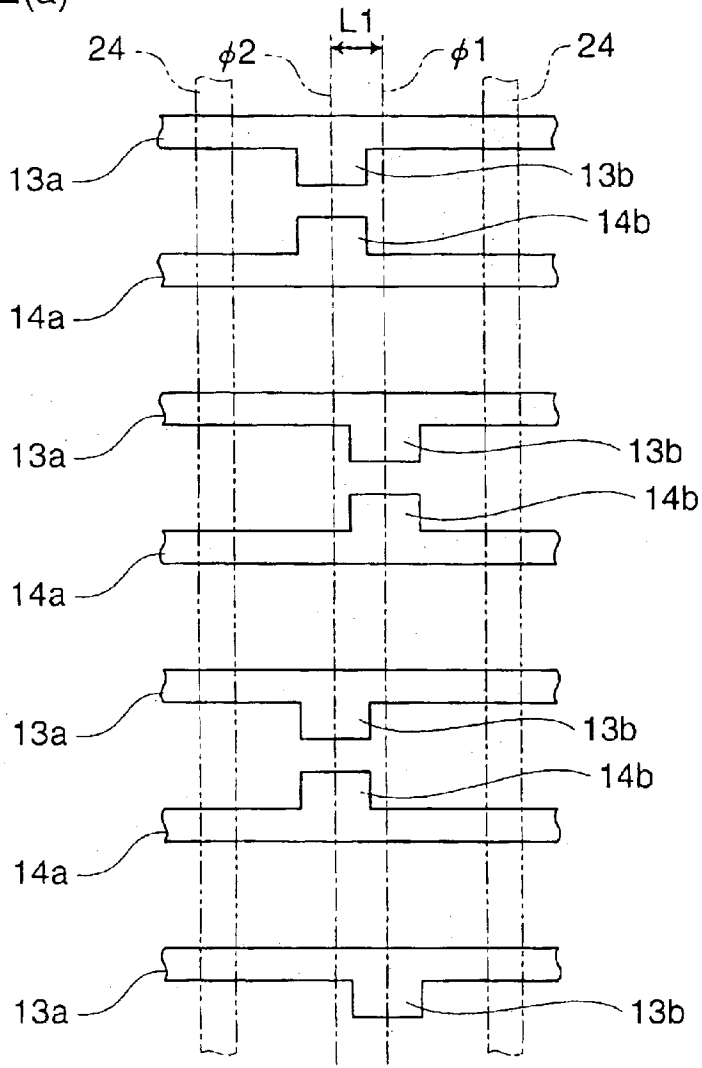

According to the feature of the present invention, the first sustain electrode 14 and the second sustain electrode 13 formed in pairs on the front substrate 1 each includes bus electrodes 14*a* and 13*a* made of a belt-shaped metal film and transparent conductive films 14*b* and 13*b* which are in the form of a rectangle (strip) or a letter T as shown in FIGS. 2(*a*) and 2(*b*) and projected from the inner edges of the bus electrodes 14*a* and 13*a*, respectively, to oppose to each other. Further, a center axis Ø1 of a pair of transparent conductive films 14*b* and 13*b* is displaced in the arranging direction of the sustain electrodes by a distance L1 from a center axis Ø2 of a pair of transparent conductive films 14*b* and 13*b* of the adjacent sustain electrode pair 10. The distance L1 is provided to inhibit discharge interference for the adjacent sustain electrode pair 10. However, if the distance L1 is extremely large, light emission from a plurality of unit light emitting regions may be biased. Therefore, it is preferred that the distance L1 is suitably determined in consideration of both of the inhibition of the discharge interference and the bias in the light emission.

The address electrode 22 on the rear substrate 2 may have a linear shape as adopted in the prior art as long as it overlaps the rectangular transparent conductive films 14*b* and 13*b* of the sustain electrode pairs 10. However, with a view of inhibiting extension of the discharge, it is desirable that the address electrode 22 is configured such that it crosses the transparent conductive films 14*b* and 13*b* between the bus electrodes 14*a* and 13*a* of the sustain electrodes 14 and 13 of the sustain electrode pair 10 (a slit) and bends in the form of a letter L between the adjacent sustain electrode pairs 10 (a reverse slit) as shown in FIG. 3(*a*) (corresponding to FIG. 2(*a*)). Instead of bending in the form of the letter L, the address electrode 22 may be bended in a sawtooth pattern to cross the transparent conductive films 14*b* and 13*b* in a slant direction.

Next, explanation is given of an example of how the plasma display panel as constructed above according to this embodiment is driven and the effect of this embodiment on inhibiting discharge coupling between the adjacent sustain electrode pairs upon driving.

As shown in FIG. 4, a single frame F for displaying a single screen includes a plurality of subframes SF1 to SFn. Each of the subframes SF1 to SFn includes a reset period RP for regularizing charges in all cells in the panel screen, an address period AP for accumulating wall charges by causing discharge in a predetermined cell to select a unit light emitting region and a sustain period SP for sustaining the discharge in the unit light emitting region by making use of the accumulated wall charges to perform display.

In the reset period RP, a reset pulse is applied to all the first sustain electrodes 14 to cause discharge in all cells, thereby erasing the wall charges. In the address period AP, a scan pulse is applied in sequence to the second sustain electrodes or the scanning electrodes 13 and an address pulse is applied in synchronization with the scan pulse to the address electrode 22 corresponding to the unit light emitting region from which light shall be emitted. Thereby, address discharge is caused in an address cell defined by the intersection of the second sustain electrode 13 and the address electrode 22 to generate the wall charges. Further, in the sustain period SP, a sustain pulse is applied alternately to the first and second sustain electrodes 14 and 13 to cause discharge repetitively in the display cell of the unit light emitting region in which the wall charges have been generated.

The gradation display on the plasma display panel is performed by changing duration of the sustain periods SP in the subframes (number of discharges) in accordance with the display data. For example, by changing the number of discharges in 8 subframes in the ratio of 1:2:4:8:16:32:64:128, 256-level gradation is realized in every unit light emitting region. Since a single pixel is made of three unit light emitting regions, full-color display of 16,770,000 (=256×256×256) colors is achieved.

In this embodiment, a pair of transparent conductive films 14*b* and 13*b* of a sustain electrode pair 10 is displaced from a pair of transparent conductive films 14*b* and 13*b* of an adjacent sustain electrode pair 10. Therefore, when the address discharge is caused selectively in an address cell between the transparent conductive film 13*b* of the second sustain electrode 13 and the address electrode 22 during the address period for selecting the unit light emitting region, the address discharge is prevented from extending to an address cell between the second sustain electrode 13 of the adjacent sustain electrode pair 10 and the address electrode 22. Thereby, false discharge in the cell is avoided. Further, even in the sustain period, the discharge interference caused by discharge extension to display cells of the adjacent sustain electrode pairs 10 is prevented, thereby false discharge is inhibited.

Embodiment 2

Figure 5B:
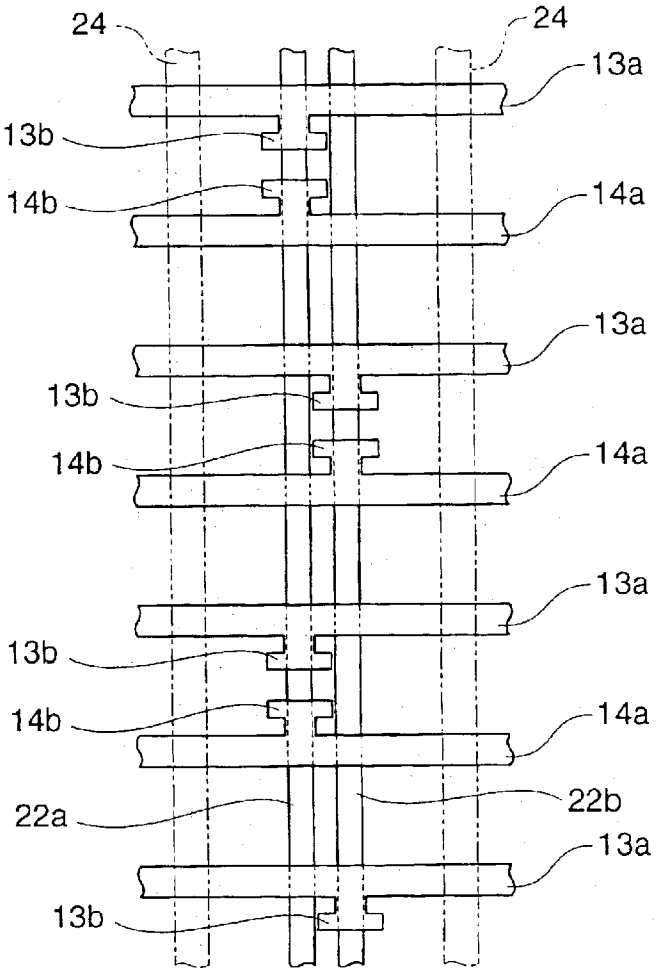
FIGS. 5(*a*) and 5(*b*) are views illustrating electrode structure on a rear substrate of a plasma display panel according to Embodiment 2 of the present invention.
Figure 5A:
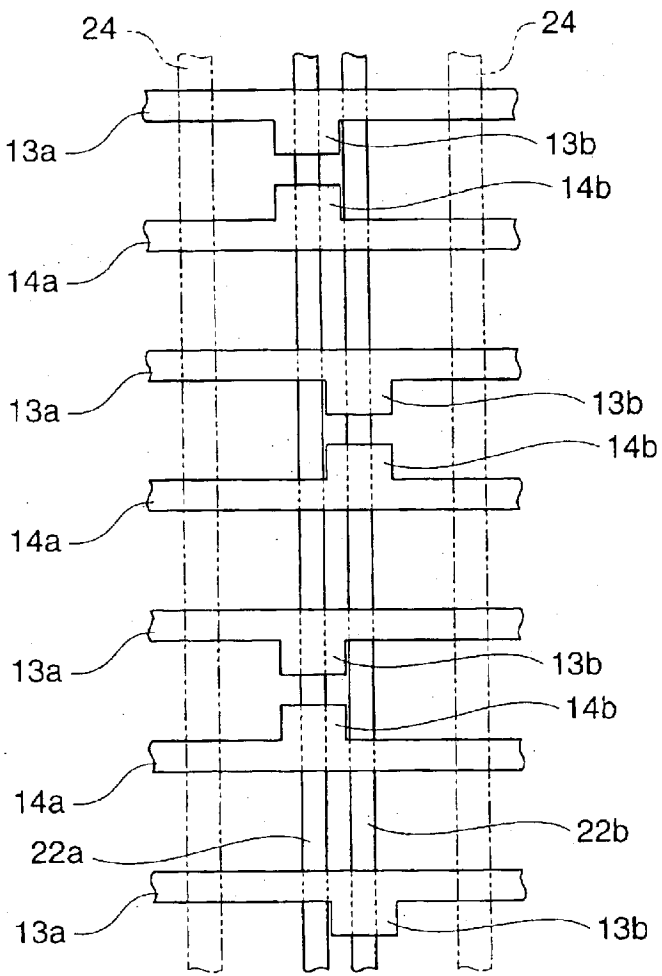

A plasma display panel according to Embodiment 2 of the present invention is described with reference to FIGS. 5(*a*) and 5(*b*). FIGS. 5(*a*) and 5(*b*) are views illustrating electrode structure of the plasma display panel according to this embodiment.

In the plasma display panel according to this embodiment, which is generally the same as the plasma display panel of Embodiment 1, the address electrode 22 shown in FIGS. 3(*a*) and 3(*b*) includes two address electrodes 22*a* and 22*b* arranged parallel to each other in correspondence with the center axes Ø1 and Ø2 (shown in FIG. 2(*a*)) of the transparent conductive films 14*b* and 13*b*, respectively. Since the two address electrodes 22*a* and 22*b* are connected to the same driving circuit to be cooperatively driven, operations during the address period are the same as those in Embodiment 1.

According to the plasma display panel of this embodiment, a pair of transparent conductive films 14*b* and 13*b* of a sustain electrode pair 10 is displaced from a pair of transparent conductive films 14*b* and 13*b* of an adjacent sustain electrode pair 10 by a predetermined distance along the sustain electrodes. Further, the two address electrodes 22*a* and 22*b* are arranged in correspondence with the center axes Ø1 and Ø2 of the transparent conductive films 14*b* and 13*b* of the sustain electrode pairs 10, respectively. Thereby, the discharge interference to the adjacent sustain electrode pair 10 is inhibited and the configuration of the address electrode 22 (see FIGS. 3(*a*) and 3(*b*)) is simplified.

Embodiment 3

Figure 6B:
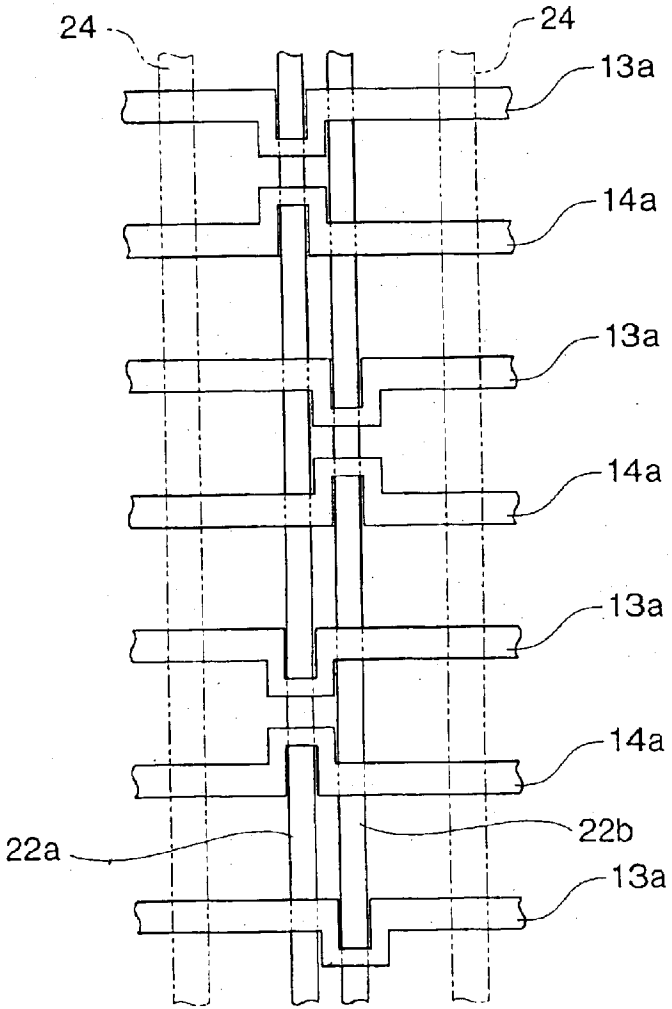
FIGS. 6(*a*) and 6(*b*) are views illustrating electrode structure of a plasma display panel according to Embodiment 3 of the present invention.
Figure 6A:
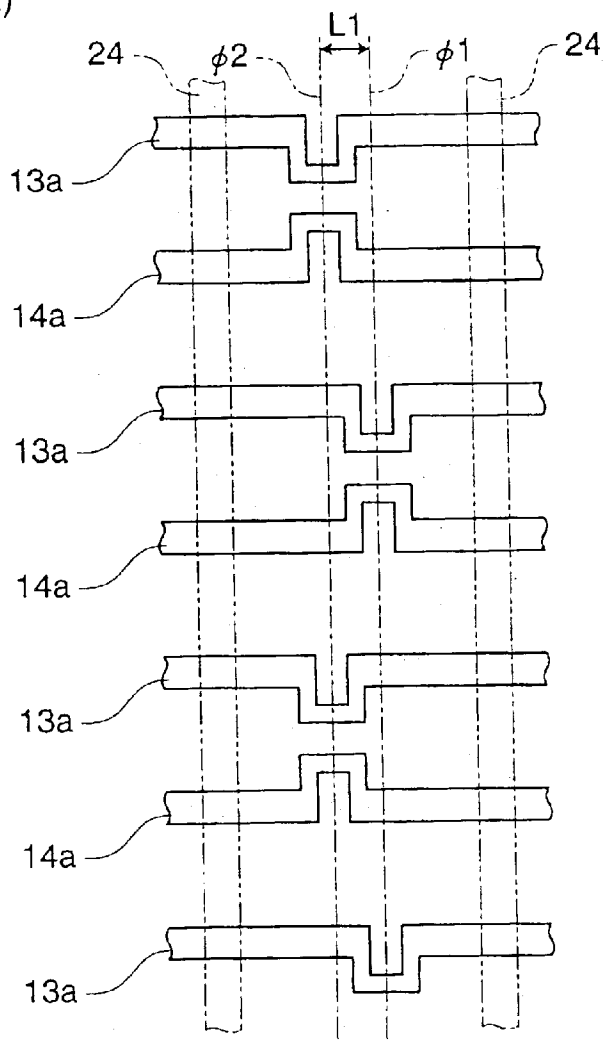

A plasma display panel according to Embodiment 3 of the present invention is described with reference to FIGS. 6(*a*) and 6(*b*). FIGS. 6(*a*) and 6(*b*) are views illustrating electrode structure of the plasma display panel according to this embodiment.

In the plasma display panel according to this embodiment, which is generally the same as the plasma display panel of Embodiment 1, the sustain electrode pair 10 does not include the pair of transparent conductive films 14*b* and 13*b* as shown in FIG. 6(*a*). Instead of forming the pair of transparent conductive films, the bus electrode 14*a* of the first sustain electrode 14 and the bus electrode 13*a* of the second sustain electrode 13 are formed to approach each other by providing portions bended into the shape of a hook in the vicinity of the intersection with the address electrodes 22*a* and 22*b*. A center axis Ø1 of a pair of bended portions of the sustain electrode pair 10 is displaced from a center axis Ø2 of a pair of bended portions of the adjacent electrode pair 10 by a distance L1 along the sustain electrodes. Further, the two address electrodes 22*a* and 22*b* are formed in correspondence with the bended portions of the sustain electrode pairs 10 in the same manner as Embodiment 2 as shown in FIG. 6(*b*). The address electrodes may be formed into the shape as shown in FIGS. 3(*a*) and 3(*b*).

The plasma display panel as constructed above according to this embodiment is operated in the same manner as Embodiment 1.

Thus, according to the plasma display panel of this embodiment, the bus electrode 14*a* of the first sustain electrode 14 and the bus electrode 13*a* of the second sustain electrode 13 are formed to approach each other at the intersection with the address electrode 22 (or the address electrodes 22*a* and 22*b*). Thereby, a sufficient width of the reverse slit is maintained to inhibit the discharge interference. Further, since there is no need of forming the transparent conductive films 14*b* and 13*b*, cost reduction is achieved.

In the plasma display panel according to this embodiment, the transparent conductive films 14*b* and 13*b* may be formed in combination with the sustain electrodes 14 and 13 whose outer configuration has been changed as shown in FIGS. 6(*a*) and 6(*b*).

In the plasma display panels according to Embodiments 1 to 3, the transparent conductive films 14*b* and 13*b* are formed in the form of a rectangle or a letter T. However, they may be formed into various shapes such as the shape of a triangle and an arc.

Figure 7B:
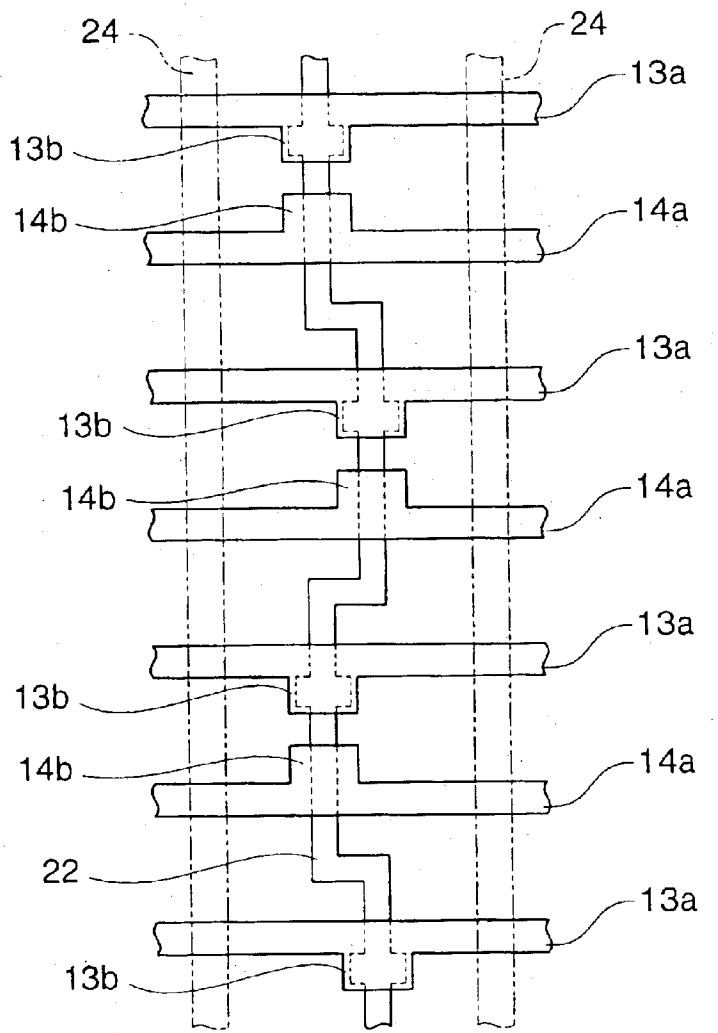
FIGS. 7(*a*) and 7(*b*) are views illustrating electrode structure of a plasma display panel according to a modified embodiment of the present invention.
Figure 7A:
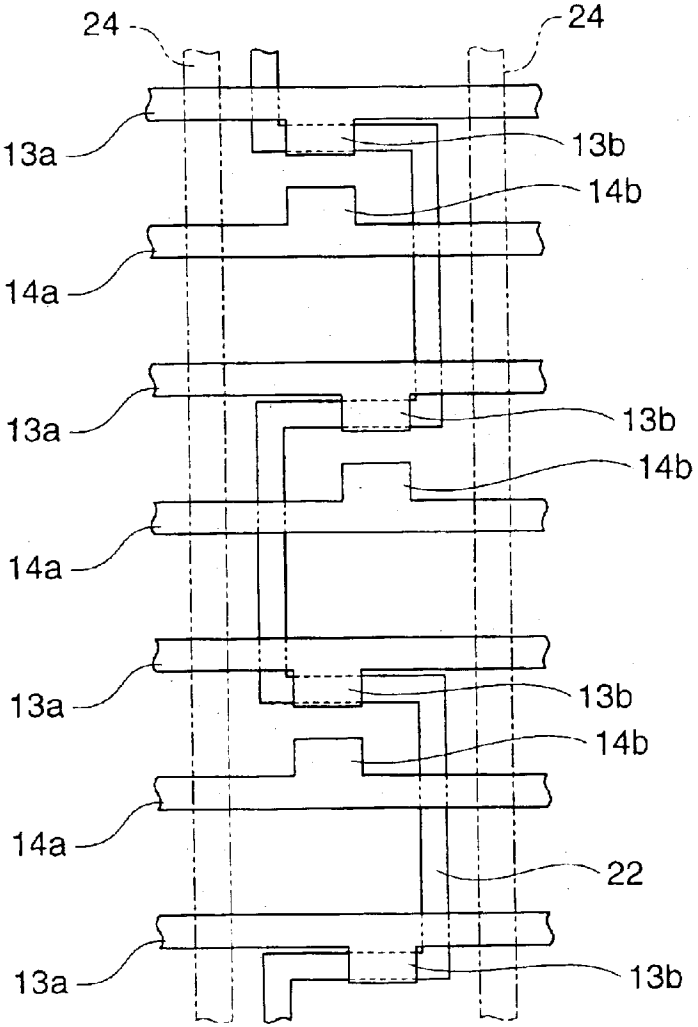

In the plasma display panels according to Embodiments 1 to 3, when the address electrode 22 (or the address electrodes 22*a* and 22*b*) is bent to be opposed to only the transparent conductive film 13*b* of the second sustain electrode 13, the address electrode 22 may overlap the first sustain electrode 14 in a smaller area (see FIG. 7(*a*)). On the other hand, the second sustain electrode 13, which causes the discharge in a region between the second sustain electrode 13 and the address electrode 22 upon addressing, overlaps the address electrode 22 in a larger area than the first sustain electrode 14 to cause the discharge more reliably. Further, false discharge between the address electrode 22 and the second sustain electrode 14 is inhibited as much as possible, thereby the unit light emitting region is selected smoothly without fault. Moreover, the discharge interference to the adjacent sustain electrode pairs 10 during the sustain period is inhibited.

In the plasma display panels according to Embodiments 1 to 3, the address electrode 22 (or the address electrodes 22*a* and 22*b*) may overlap the second sustain electrode 13 in a larger area (see FIG. 7(*b*)). Thereby, the unit light emitting region can be selected with higher precision.

Figure 8B:
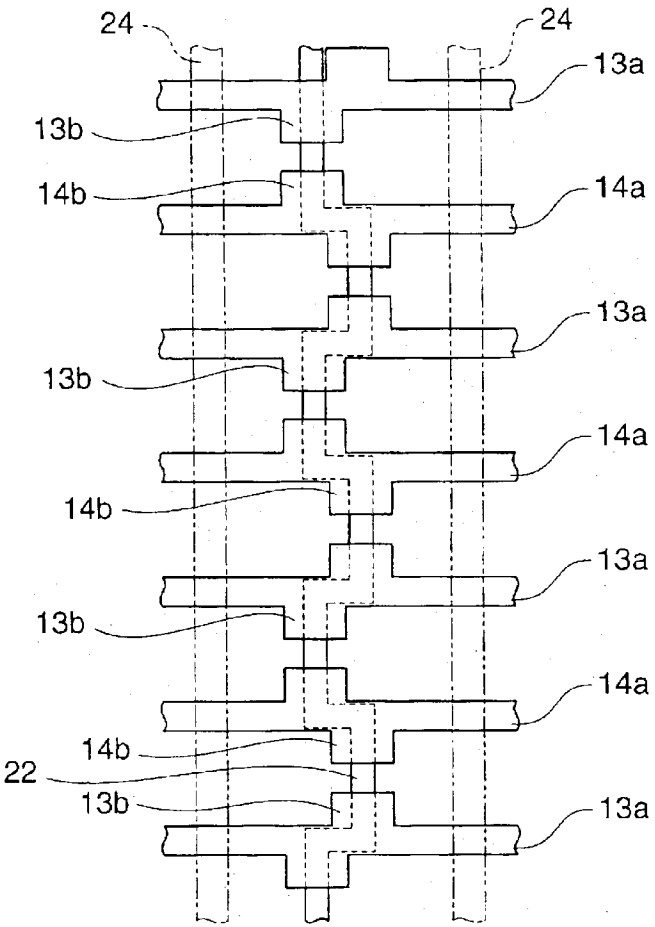
FIGS. 8(*a*) and 8(*b*) are views illustrating electrode structure of a plasma display panel according to another modified embodiment of the present invention.
Figure 8A:
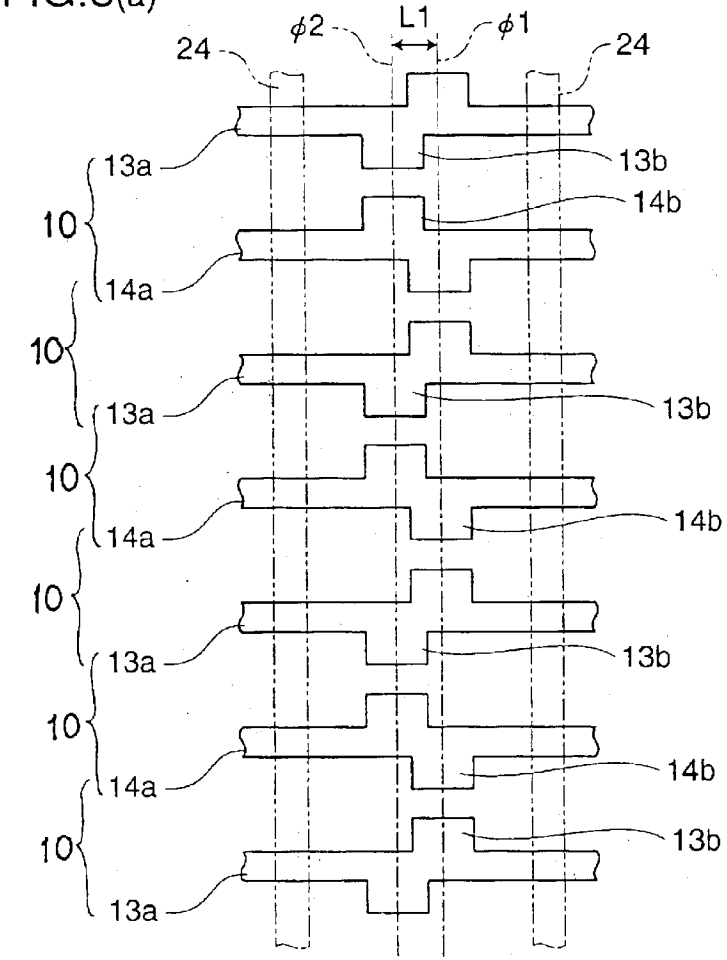
Figure 9:
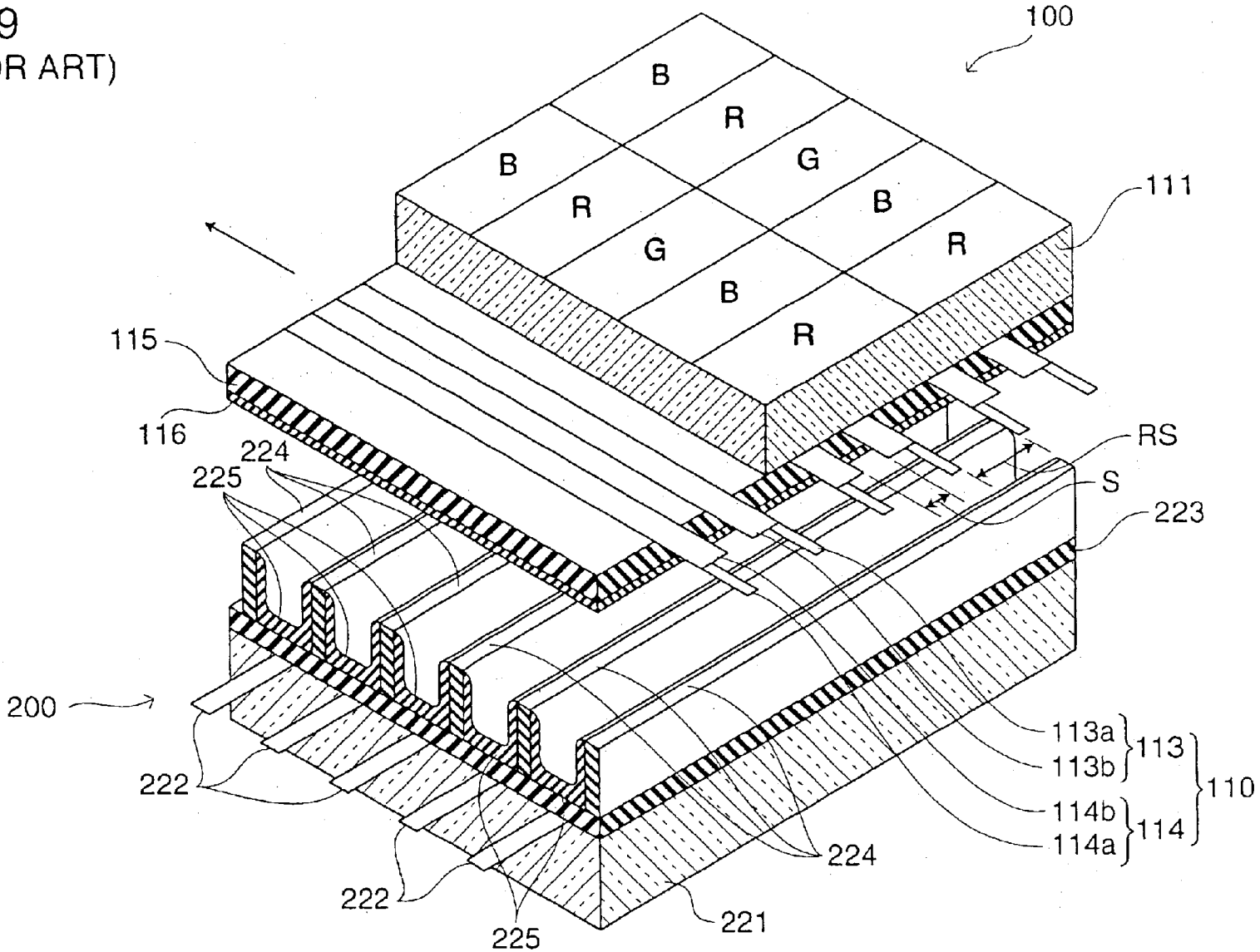
FIG.9 (PRIOR ART)
FIG. 9 is a perspective view partially illustrating a prior art plasma display panel.
Figure 10:
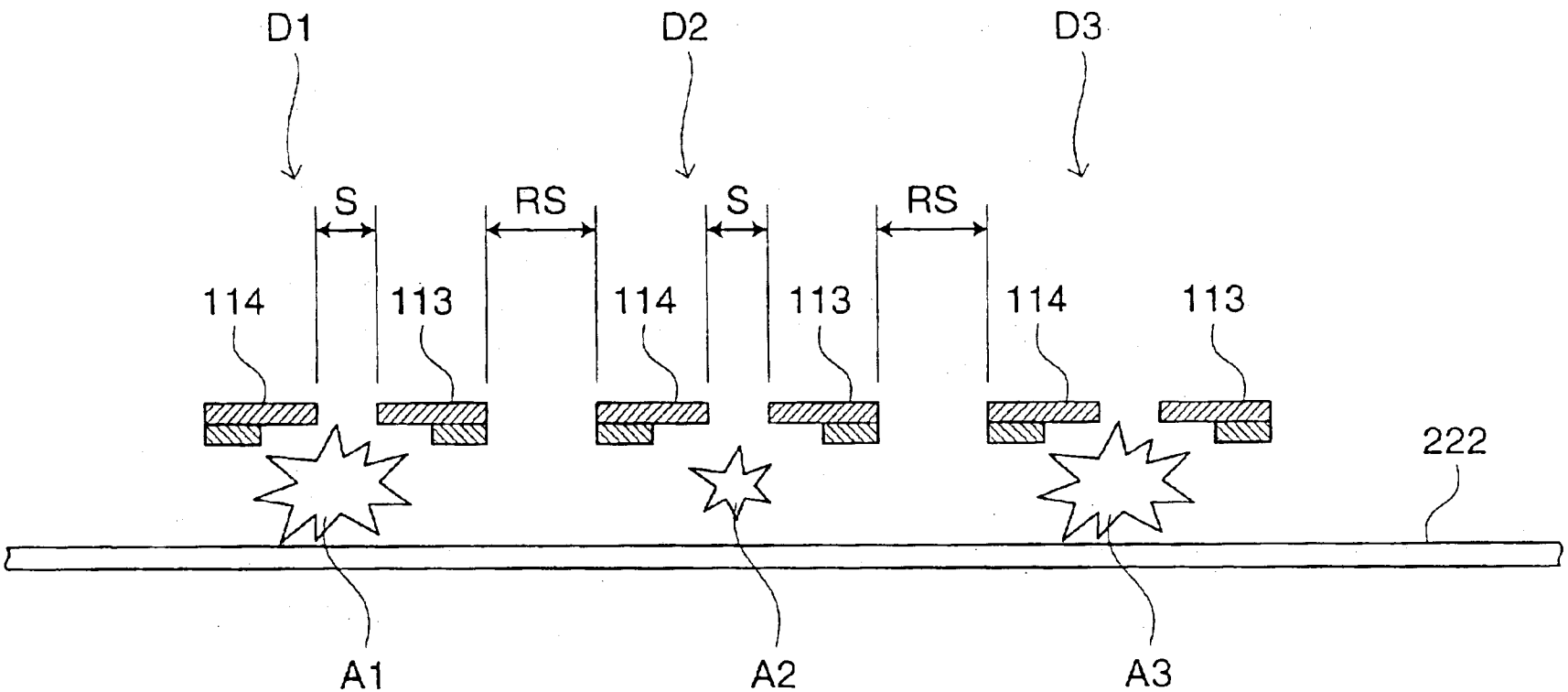
FIG.10 (PRIOR ART)
FIG. 10 is a view illustrating a problem of the prior art plasma display panel.

In the case where ALIS is applied to the plasma display panels according to Embodiments 1 to 3, the transparent conductive films 14*b* and 13*b* may be arranged as shown in FIGS. 8(*a*), 8(*b*) such that the transparent conductive films 13*b* and 14*b* of the sustain electrode pair 10 is displaced from the transparent conductive films 13*b* and 14*b* of the adjacent sustain electrode pair 10. That is, the first sustain electrode 14*a* can cause a surface discharge with respect to both second sustain electrodes 13*a* and 13*a* adjacent to itself, while the second sustain electrode 13*a* can cause a surface discharge with respect to both first sustain electrodes 14*a* and 14*a* adjacent to itself.

In the plasma display panels according to Embodiments 1 to 3, a pair of transparent conductive films 13*b* and 14*b* of a sustain electrode pair 10 is displaced from a pair of transparent conductive films 13*b* and 14*b* of an adjacent sustain electrode pair 10. However, the transparent conductive films 14*b* and 13*b* of the sustain electrode pairs 10, which may possibly cause the interference therebetween, may be staggered in a staircase pattern.

In the plasma display panel according to Embodiment 1, the address electrode 22 is bended in correspondence with the conductive transparent films 14*b* and 13*b* of the sustain electrode pairs 10. However, the address electrode 22 may be arranged irrespectively of the conductive transparent films 14*b* and 13*b* to simplify the configuration of the address electrode. Thereby, the productivity is increased.

What is claimed is:

1. A plasma display panel comprising a first substrate and a second substrate opposed to each other, a plurality of sustain electrodes arranged parallel to each other on an inside surface of the first substrate, a plurality of ribs arranged orthogonally to the sustain electrodes on an inside surface of the second substrate, and elongated address electrodes each arranged between adjacent ribs, wherein adjacent sustain electrodes have a pair of protrusions oppositely projected in a direction approaching each other and one pair of protrusions of two adjacent sustain electrode pairs is displaced from the other pair of protrusions along the sustain electrodes between the ribs.

2. A plasma display panel according to claim 1, wherein the address electrode is bended so as to be positioned in correspondence with each pair of protrusions of the two adjacent sustain electrode pairs.

3. A plasma display panel according to claim 1, wherein each of the address electrodes includes two parallel electrodes which are cooperatively driven, one of the electrodes being arranged in correspondence with the one pair of protrusions of the two adjacent sustain electrode pairs, the other being arranged in correspondence with the other pair of protrusions.

4. A plasma display panel according to claim 1, wherein the two adjacent sustain electrode pairs each include first and second sustain electrodes, the first and second sustain electrodes causing a surface discharge therebetween for display, the second sustain electrode and the address electrode causing a discharge therebetween for selecting an address, the address electrode being opposed to the protrusion of the second sustain electrode and not opposed to the protrusion of the first sustain electrode.

5. A plasma display panel according to claim 1, wherein the two adjacent sustain electrode pairs each include first and second sustain electrodes, the first and second sustain electrodes causing a surface discharge therebetween for display, the second sustain electrode and the address electrode causing a discharge therebetween for selecting an address, the address electrode overlapping the protrusion of the second sustain electrode in a larger area than the protrusion of the first sustain electrode.

6. A plasma display panel according to claim 1, further comprising a fluorescent layer formed on each address electrode.

7. A plasma display panel according to claim 1, wherein the plurality of sustain electrodes include a plural of sustain electrode pairs, each pair being composed of two adjacent sustain electrodes, the sustain electrode pairs being spaced apart each other by a distance not enough to cause a discharge therebetween, the pair of opposed protrusions of each sustain electrode pair causing a surface discharge therebetween.

8. A plasma display panel according to claim 1, wherein the plurality of sustain electrodes are spaced apart each other by a distance enough to cause a surface discharge between desired adjacent sustain electrodes, the surface discharge being caused between each pair of protrusions.

9. A plasma display panel according to claim 1, wherein the sustain electrode is made of a band-shaped metal film and the protrusion is made of a transparent conductive film.

10. A plasma display panel according to claim 1, wherein the sustain electrode is made of a band-shaped metal film and the protrusion is made by partially bending the sustain electrode.

* * * * *